United States Patent [19]

Brockhoff

[11] Patent Number: 5,014,984

[45] Date of Patent: May 14, 1991

[54] BATTING APPARATUS

[76] Inventor: Joseph Brockhoff, 535 Homestead Ave., Metairie, La. 70005

[21] Appl. No.: 330,609

[22] Filed: Mar. 30, 1989

[51] Int. Cl.[5] ..... A63B 69/40

[52] U.S. Cl. ..... 273/26 B; 273/72 R; 273/67 R

[58] Field of Search ..... 273/26 R, 26 B, 67 R, 273/72 R, 29 A, 67 DB, 67 DA, 73 J, 75, 81 R, 81 D, 81 B, 165, 81.4

[56] References Cited

U.S. PATENT DOCUMENTS

| | | | |
|---|---|---|---|
| 1,071,344 | 8/1913 | Provan | 273/81.4 |
| 1,542,396 | 6/1925 | Klink | 273/72 R |
| 1,936,579 | 11/1933 | Becket et al. | 273/72 R |
| 2,069,723 | 2/1937 | Morrow | 273/72 R |
| 2,091,458 | 8/1937 | Sleight | 273/72 R |
| 2,099,521 | 11/1937 | Herkimer et al. | 273/72 R |
| 3,111,322 | 11/1963 | English | 273/81.4 |
| 3,227,455 | 1/1966 | Hulsman | 273/81.4 |
| 3,246,894 | 4/1966 | Salsbury | 273/72 R |
| 3,716,885 | 2/1973 | Thompson | 273/126 R |
| 3,921,978 | 11/1975 | Warren | 273/67 R |
| 4,032,143 | 6/1977 | Mueller et al. | 273/72 R |
| 4,343,467 | 8/1982 | Newcomb et al. | 273/72 R |

*Primary Examiner*—Theatrice Brown

*Attorney, Agent, or Firm*—Pravel, Gambrell, Hewitt, Kimball & Krieger

[57] ABSTRACT

A practice baseball bat having an elongated shaft of predetermined length. One end of the shaft has a handgrip portion having a plurality of spaced apart and aligned raised portions which extend between the fingers of a batter's hands so that when the bat is swung, the raised portions will be moved from a first up position to a position in the direction of which the bat is swung. The bat further has an elongated enlarged cylindrical ball contact portion which extends intermediate the ends of the shaft and adjacent the other end of the shaft, the ball contact portion being coaxial with the shaft. The other end of the shaft defining a nub extending from one end of the enlarged portion to the end of the bat.

4 Claims, 2 Drawing Sheets

BATTING APPARATUS

BACKGROUND OF THE INVENTION

1. Field of the Invention

The apparatus of the present invention relates batting in baseball. More particularly, the present invention relates to an apparatus which simulates a baseball bat and provides for more accurate manipulation in swinging of the bat to increase ones hitting potential.

2. General Background

In the sport of baseball or other like sport where a stick is used to make contact with a spherical ball, one of the most prevalent problems confronted by players is a problem with undertaking a proper swing of the bat in order to make the proper contact with the ball which would result in a base hit or other positive ball contact. One example of such a problem is the fact that most hitters as they learn to hit after the grasping the bat at the end with both hands would tend to rotate the wrists during the swing, which would of course would result in improper rotation of the bat, the end result being no contact or improper contact with the ball. A second more fundamental problem is the problem of the hitter making contact with the ball along the heavier or "sweet spot" portion of the bat i.e., that portion between the elongated grasping or handle area, and the very nub or distal end of the bat. Contact with the handle portion would normally result in a breaking of the bat; contact with the distal end nub of the bat would tend to result in a foul or a very unsatisfactory travel of the ball after being struck.

Those patents that were found in the art which may be pertinent to the present invention are summarized as follows:

U.S. Pat. No. 4,555,111 issued to Alvarez entitled "Practice Bat" relates to a bat for baseball players having a weighted end portion which interconnects to a resilient spring so that when the bat is swung the weighted end would tend to lag behind the greater portion of the bat due to the resiliency of the spring, and would tend to whip forward after the bat has been stopped, causing the players wrist to break or bend.

U.S. Pat. No. 4,682,773 entitled "Baseball Training Bat" issued to Pomillia includes an elongated hollow member weighing between forty-eight (48) and fifty-five (55) ounces in weight and having a central cap including a handle portion to be gripped by the batter wherein there is an item in the central cavity for reinforcing the hollow member against bending. The weight of the bat along the length of it being such that the diameter of the bat is constant along its length rather than heavier as it gets to the distal end of the bat.

U.S. Pat. No. 4,343,467 entitled "Short Hitting Baseball Bat" issued to Newcomb et al. which is constructed of a flexible material which allows the bat to sag or bend noticeably as it is wagged back and forth by a batter.

U.S. Pat. No. 3,179,412 issued to Niederberger entitled "Torque Ball" relates to a bat designed in such a manner that the ball is hit only a short distance.

U.S. Pat. No. 4,186,921 issued to Fox entitled "Method of Making a Tethered Ball Apparatus" relates to forming a tether ball practice apparatus by attaching one end of a hollow braided tether line to a hollow perforated ball and the other end of the line to a handle member.

U.S. Pat. No. 4,573,679 issued to Janzen entitled "Water Powered Batting Device" relates to a batting device where a ball at the end of a line is rotated by water propulsion so that as a squirrel cage rotates, the tether ball rotates in the opposite direction and water is flung outwardly in a wide pattern.

SUMMARY OF THE PRESENT INVENTION

The apparatus of the present invention solves the shortcomings in the art in a simple and straightforward manner. What is provided is a practice baseball bat having a handle portion, including grip members so that a plurality of directional points are positioned intermediate the fingers of the batter, so that when the bat is swung, the points move from a first up position prior to the swing, to a position forward of the bat when the swing is completed; an elongated central portion of equal diameter as the handle portion; a hitting portion of a diameter relatively equal to that of a conventional bat, and a hand distal nub portion, of substantially equal diameter to the elongated body portion.

It is further provided that the lightweight embodiment would have a lightweight wood body construction, with the batting portion constructed of a soft, compressible material for making contact with a lightweight ball such as a "whiffle ball"; and the second heavyweight embodiment would be such that the body portion would be a resilient material such as stainless steel or aluminum, with the batting portion being of a less compressible and more solid material, for practice swinging against a throw of a conventional baseball.

Therefore, it a principal object of the present invention to provide a practice bat for enabling the hitter to properly rotate his wrists during the complete swing at a baseball;

It is a further object of the present invention to provide a practice baseball bat having a batting portion of the conventional width as a standard bat, only along that portion of the bat where the ball should be struck;

It is a further object of the present invention to provide a baseball bat having a body portion intermediate the batting portion and gripping portion, which is of a reduced diameter to resist striking of that portion with the baseball during practice;

It is a further object of the present invention to provide a practice baseball bat having a distal end portion, which is of a reduced diameter than the batting portion, to resist making contact with the ball on the distal end portion.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
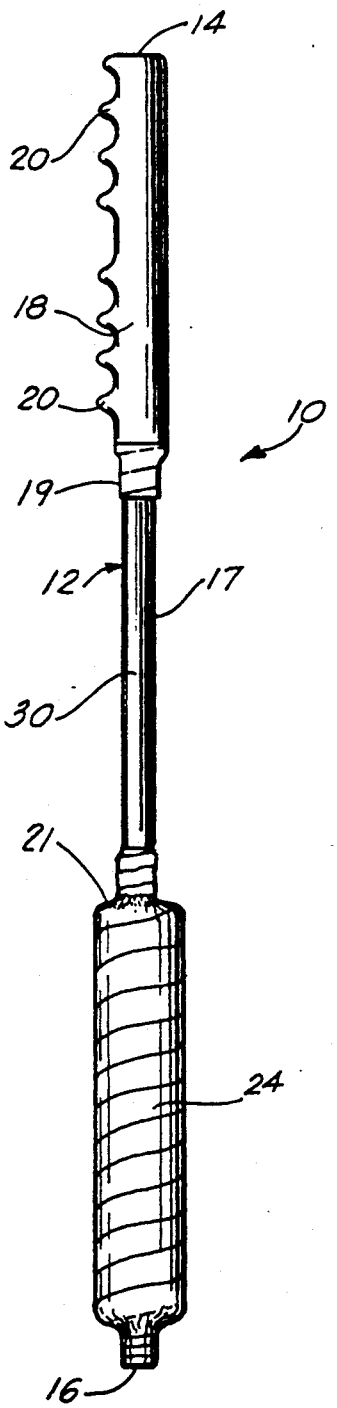
FIG. 1 illustrates an overall view of the preferred embodiment of the apparatus of the present invention.

As is illustrated in FIGS. 1–4, the preferred embodiment of the apparatus of the present invention is illustrated by the numeral 10. A practice baseball bat 10 would comprise an elongated body portion 12 extending from a first proximal end 14 closer to the body of the batter, and a distal or "button" end 16, farthest away from the body of the batter during swinging. In the preferred embodiment of the invention which is the "lightweight" embodiment, body 12 would comprise either an elongated portion of wood or other light material that would be very easy to swing during practice. Further, as illustrated, the proximal end 14 of the apparatus 10 would include a grasping or handle portion 18 which would comprise a material such as plastic or rubber, formed around the outer wall 17 of body portion 12, a distance so as to accommodate the double gripping of a conventional baseball grip. Handle portion 18 would further include a plurality of points 20 substantially equally spaced along the length of handle portion 18, so that each finger of the conventional batter would be positioned intermediate a pair of the points extending out therefrom.

Turning now to FIGS. 2A and 2B, and 3A and 3B, FIGS. 2A–2B illustrate points 20 when the practice bat 10 is laid upon the batter's shoulder in position ready to swing at an oncoming ball, with points 20 positioned in the up position in the direction of arrow 22. In a proper swing, reference is made to FIGS. 3A–3B, where points 20 have rotated substantially ninety degrees (90°) to the front of the bat i.e., would be preceding handle 18 to the point that contact is made with the oncoming ball. It is through the rotation of point 20 from the twelve o'clock position (FIG. 2B) to the three o'clock position (FIG. 3B) during swinging, that the proper rotation of the wrist during this critical area of the swing is recognized, and can be undertaken during practice over numerous swings of the bat.

Turning now to additional structure, there would further be provided a batting portion 24 along the length of body member 12, extending substantially from the nub portion 16 of body portion 12 a distance of approximately twelve inches (12"), the batting portion 24 being of substantially constant diameter throughout, and being of a substantial diameter equal to that of a conventional baseball bat. As illustrated in the FIGURES, batting portion 24 starts and ends abruptly at both ends, and represents the "sweet spot" along the length of a bat that a baseball should make contact with during a proper swing when hitting the ball. For purposes of construction, in the preferred embodiment, batting portion 24 would comprise a lightweight material 26 such as sponge or the like, enveloped around the wooden body portion 12 of bat 10 (FIG. 4), and would be soft and compressible, the preferred embodiment would be utilized in making contact with a lightweight ball such as a whiffle ball.

Interconnecting the batting portion 24 with the handle portion 18, would be an intermediate body portion 30, which would comprise that length of body portion 12 extending between the very lower end 21 of batting portion 20, and the upper end 19 of handle portion 18. For purposes of construction, that portion of the body portion 12 would be substantially constant along its length and would be of a diameter equal to the diameter of the body portion around which the handle grips are formed during use. It is through this narrow construction of that intermediate portion 30 that the hitter learns that contact with the ball along that portion of the practice bat represents poor contact with the ball or inadequate contact with the ball utilizing a conventional bat.

As was stated earlier, the very nub or end portion 14 of the bat, is illustrated again as a short extension of body portion 12 extending out of the distal end of batting portion 24. Then, this reduced diameter end portion, represents the very end or nub of the distal end of a conventional bat, so that when contact is made with the nub portion, it is contact which should be avoided.

Figure 5:
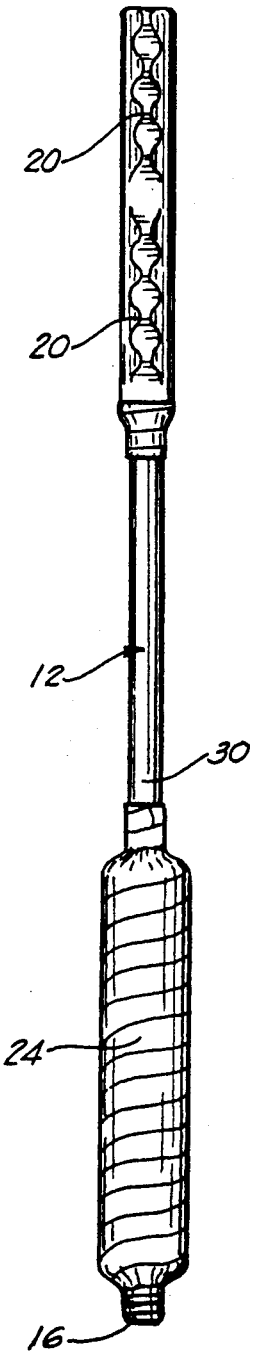
FIG. 5 illustrates an overall additional embodiment of the apparatus of the present invention.
Figure 4:
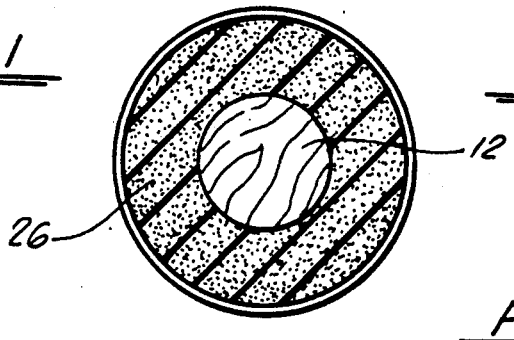
FIG. 4 represents a cross-sectional view along lines 4—4 in FIG. 1.
Figure 2B:
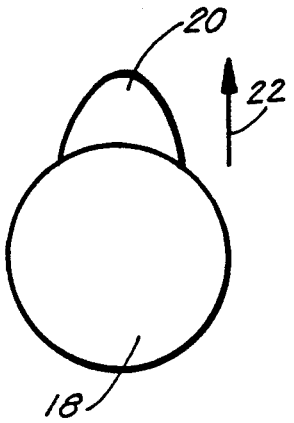
FIGS. 2A and 2B represent a partial view of the handle portion in a representational view of the handle portion respectively prior to swinging the apparatus of the present invention.
Figure 2A:
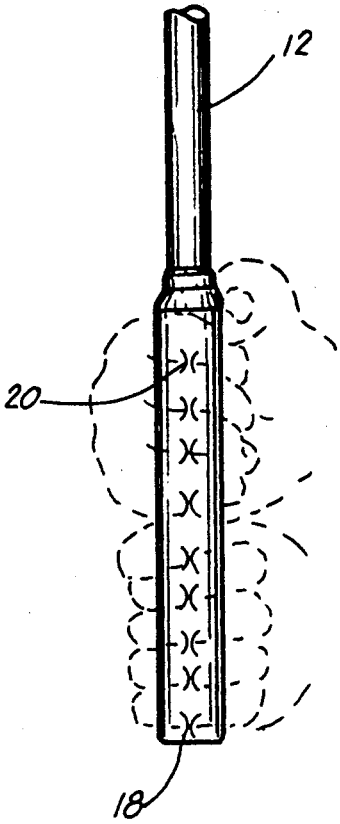
Figure 3B:
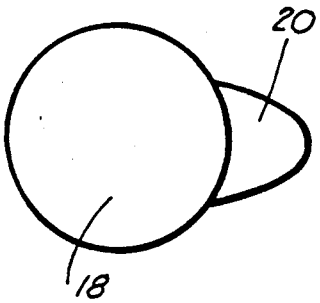
FIGS. 3A and 3B illustrate a partial view of the handle portion and a representational view of the handle portion following the swing of the apparatus of the present invention.
Figure 3A:
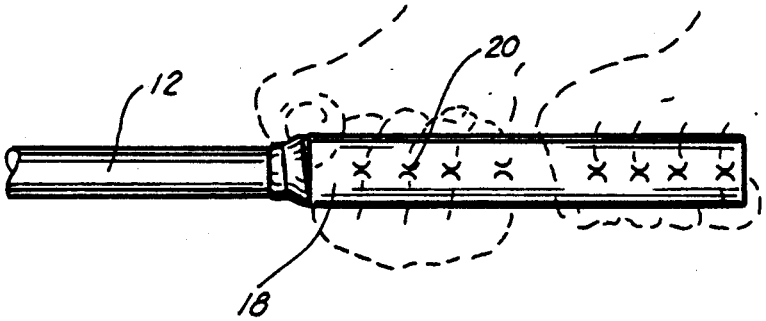

FIG. 5 would be of the identical construction as illustrated in FIGS. 1–3, with the exception that the materials would be of a different nature. The embodiment as illustrated in FIG. 5 would be adapted to be utilized with a conventional baseball, and therefore would be constructed of more enduring materials. For example the body portion 12 would be of a lightweight metal such as aluminum, and the batting portion 24 other than a sponge or compressible material such as in the preferred embodiment, would be of a hard material such as heavy duty plastic, or even wood, which would represent both in weight and contact with a ball, a more conventional type bat for use during swinging.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A practice baseball bat, comprising:

(a) an elongated rigid body portion, said body portion having a substantially constant diameter and having distal and proximal ends thereof;

(b) handle means at said proximal end for accommodating both hands of a batter when the hands are positioned in close relation to said proximal end of said body portion, said handle means further comprising means for visually indicating said rotation of the wrists of the batter from a first resting position, to a position when contact is made with a ball;

(c) an enlarged batting portion made of a material different from that of said rigid body portion, said batting portion being an enlarged area positioned near said distal end portion and extending a predetermined distance along the length of said rigid body portion, said enlarge portion representing that portion of said bat in which contact with a ball is to be made; and (d) said elongated rigid body portion at said distal end portion extends past said enlarged batting portion to define a nub of said bat.

2. The apparatus in claim 1, wherein the diameter of the elongated body portion is under one inch in diameter.

3. The apparatus of claim 1, wherein the batting portion further comprises a substantially thickened area of soft compressible material which defines the preferred area of the bat that contact with the ball is to be made.

4. The apparatus of claim 1, wherein the reduced distal end portion of the bat defines a portion of the bat wherein undesired contact with the ball is to be made.

* * * * *